United States Patent [19]

Minalga et al.

[11] 4,318,357

[45] Mar. 9, 1982

[54] DATA ADVANCING ARRANGEMENT IN A SEWING MACHINE

[75] Inventors: Philip F. Minalga, Piscataway; Edward A. Salge, Parlin, both of N.J.

[73] Assignee: The Singer Company, Stamford, Conn.

[21] Appl. No.: 238,775

[22] Filed: Feb. 27, 1981

[51] Int. Cl.[3] ..... D05B 3/02

[52] U.S. Cl. ..... 112/158 E

[58] Field of Search ..... 112/158 E, 220, 121.11, 112/121.12, 275, 277; 318/799

[56] References Cited

U.S. PATENT DOCUMENTS 4,131,075 12/1978 Wurst ..... 112/158 E 4,159,002 6/1979 Minalga ..... 112/158 E

FOREIGN PATENT DOCUMENTS 54-144248 11/1979 Japan .

*Primary Examiner*—Peter P. Nerbun

*Attorney, Agent, or Firm*—David L. Davis; Robert E. Smith; Edward L. Bell

[57] ABSTRACT

An arrangement in an electronically controlled stitch pattern sewing machine which detects when the sewing machine is operating at speeds above a predetermined speed and when this is the case, instead of utilizing the bight synchronization signal generated by the armshaft timing pulse generator, the arrangement calculates a speed dependent time interval after the feed synchronization pulse so as to begin processing the bight data at some time prior to the bight synchronization pulse.

7 Claims, 7 Drawing Figures

| SPEED (RPM) | CYCLE TIME (M SEC.) | SHUNT TIME (M SEC.) | DELAY (M SEC.) |
|---|---|---|---|
| 850 | 70 | 31 | 27 |
| 900 | 66 | 29 | 25 |
| 950 | 63 | 28 | 23 |
| 1000 | 60 | 26 | 22 |
| 1050 | 57 | 25 | 21 |
| 1100 | 54 | 24 | 19 |
| 1150 | 52 | 23 | 18 |
| 1200 | 50 | 22 | 17 |
*Fig. 3.*
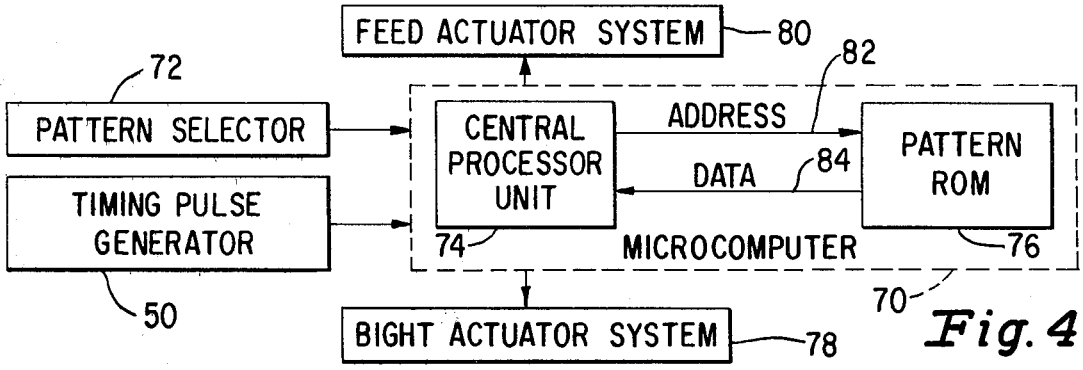
*Fig. 4.*
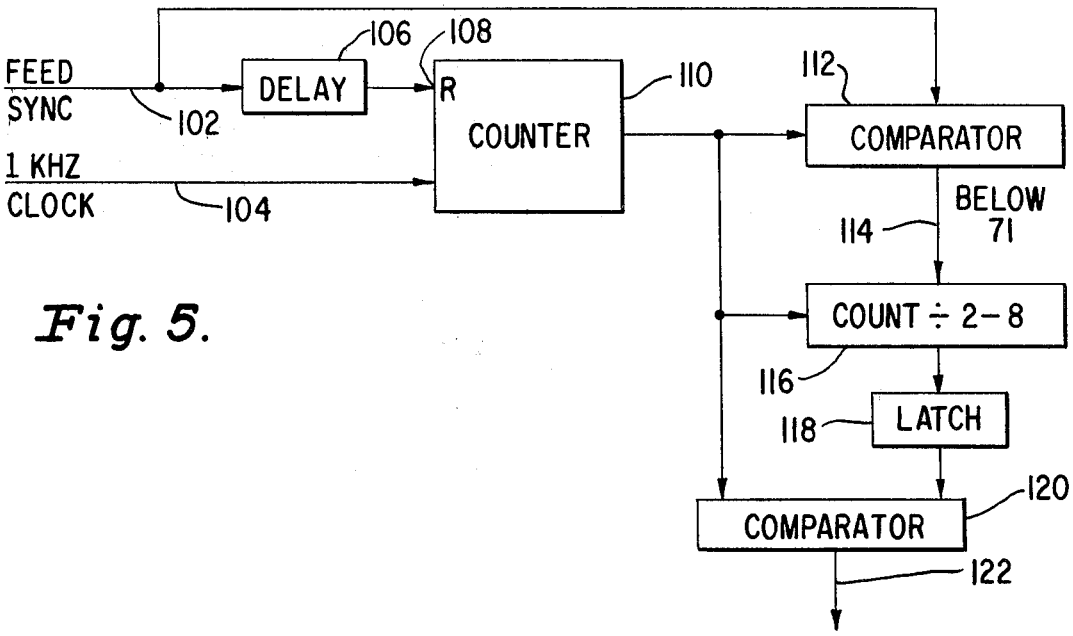
*Fig. 5.*

DATA ADVANCING ARRANGEMENT IN A SEWING MACHINE

DESCRIPTION

BACKGROUND OF THE INVENTION

This invention relates to sewing machines and, more particularly, to electronic controls for positioning stitch forming instrumentalities thereof.

Sewing machines are known in the prior art wherein the positional coordinates for successive stitch penetrations are stored in a memory having addressable locations corresponding to a plurality of operator selectable patterns. In particular, such known sewing machines include logic circuitry which is used to select and release the stitch pattern information stored in the memory in timed relation with the operation of the sewing machine. Digital information from the memory is converted to positional analog signals which control closed loop servo systems including moving coil linear actuators directly controlling the position of conventional stitch forming instrumentalities of the sewing machine to reproduce a pattern of stitches corresponding to the selected stitch information. The timing signals for operating the logic circuitry are generally derived from a timing pulse generator coupled to the horizontal armshaft of the sewing machine. Accordingly, the timing signals are generated in synchronism with the operation of the sewing machine at fixed points relative to each operating cycle of the sewing machine and the spacing between the timing signals is dependent upon the speed of operation of the sewing machine. Thus, a faster sewing machine speed causes the timing signals to be spaced closer together than a slower sewing machine speed. In general, the response time of the servo system including the linear actuator is sufficiently fast to properly position the stitch forming instrumentalities between stitches at any speed within the normal range of sewing machine speeds. However, under certain circumstances, when the sewing machine is operating above some threshold speed, there may be insufficient time to properly position a stitch forming instrumentality if the mechanically synchronized timing pulses are utilized. It is therefore an object of the present invention to insure that the stitch forming instrumentalities are properly positioned at all operating speeds of the sewing machine.

SUMMARY OF THE INVENTION

The foregoing and additional objects are attained in accordance with the principles of this invention in an electronically controlled stitch pattern sewing machine including at least one stitch forming instrumentality positionally controllable over a predetermined range, memory means for storing pattern stitch information, means for providing a first synchronization signal at a first fixed point during each operating cycle of the sewing machine, means for providing a second synchronization signal at a second fixed point during each operating cycle of the sewing machine, retrieval means utilizing the first and second synchronization signals for operating in timed relation with the sewing machine to retrieve selected pattern stitch information from the memory means, and actuating means responsive to the retrieved pattern stitch information for controlling the position of the stitch forming instrumentality, by providing means for sensing when the speed of operation of the sewing machine is faster than a predetermined speed, signal generating means responsive to the sensed speed being faster than the predetermined speed for generating a third synchronization signal which occurs after the first synchronization signal and before the second synchronization signal, and means for substituting the third synchronization signal in place of the second synchronization signal for response thereto by the retrieval means.

In accordance with an aspect of this invention, the signal generating means includes means for varying the time interval between the first synchronization signal and the third synchronization signal as an inverse function of the sewing machine speed.

BRIEF DESCRIPTION OF THE DRAWINGS

The foregoing will be more readily apparent upon reading the following description in conjunction with the drawings in which:

FIG. 3 is a table showing various time periods of interest to the present invention;

FIG. 4 illustrates a general block diagram of a microcomputer based controller for the sewing machine shown in FIG. 1;

FIG. 5 is a block diagram illustrative of a hardware implementation of the present invention.

DETAILED DESCRIPTION

Figure 1:
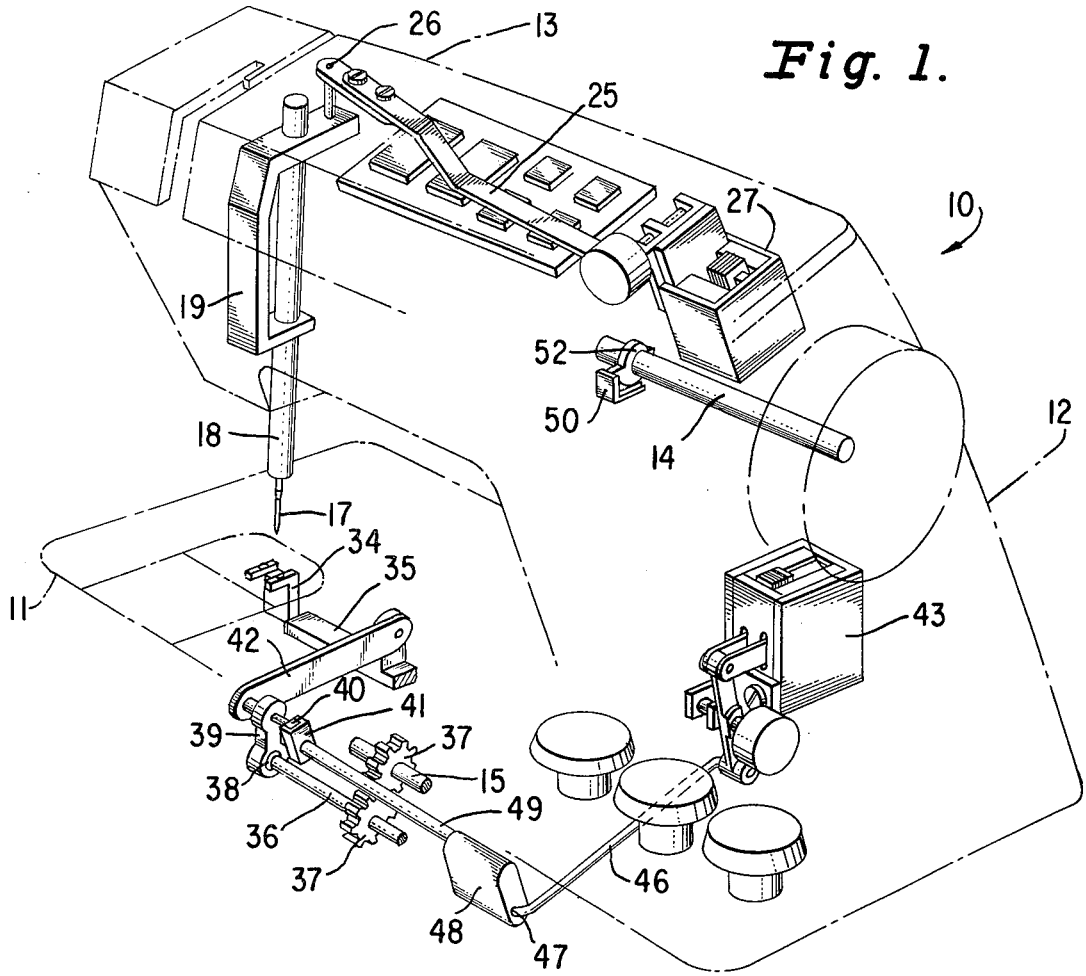
FIG. 1 is a perspective view of a sewing machine, in phantom outline, in which an arrangement constructed in accordance with the principles of this invention may be incorporated.

Referring to the drawings, as shown in phantom outline in FIG. 1, a sewing machine casing 10 includes a bed 11, a standard 12 rising from the bed 11 and a bracket arm 13 overhanging the bed 11. The driving mechanism of the sewing machine includes an armshaft 14 and a bedshaft 15 interconnected in timed relation by a conventional mechanism including a drive motor (not shown). A needle 17 is carried for endwise reciprocation by a needle bar 18 mounted for lateral jogging movement in a gate 19 in the bracket arm 13 for imparting lateral jogging movement to the needle 17. A drive link 25 is pivoted as at 26 to the gate 19 and provides the mechanical connection to a reversible linear actuator 27, illustratively of the type described in U.S. Pat. No. 4,016,441. The linear actuator 27 may therefore be controlled to determine the lateral position of the sewing needle 17.

Also illustrated in FIG. 1 is a fragment of a work feed mechanism including a feed dog 34 carried by a feed bar 35. The mechanism illustrated for imparting work transporting movement to the feed dog 34 includes a feed drive shaft 36 driven by gears 37 from the bed shaft 15, a cam 38 on the feed drive shaft 36, and a pitman 39 embracing the cam 38 and connected to reciprocate a slide block 40 in a slotted feed regulating guideway 41. A link 42 pivotably connects the pitman 39 with the feed bar 35 so that depending upon the inclination of the guideway 41, the magnitude and direction of the feed stroke of the feed dog 34 will be determined. The inclination of the guideway 41 may be controlled by a reversible linear actuator 43, illustratively of the same type of the linear actuator 27. The linear actuator 43 is connected to a link 46 pivoted at 47 to a rock arm 48 which is secured on a rock shaft 49 to which the guideway 41 is affixed.

Also shown in FIG. 1 is a timing pulse generator 50 which may be of the type shown and described in U.S. Pat. No. 3,939,372. The pulse generator 50 provides a train of timing pulses, one for each rotation of the armshaft 14, which pulses are utilized in a manner to be described hereinafter.

Figure 2:
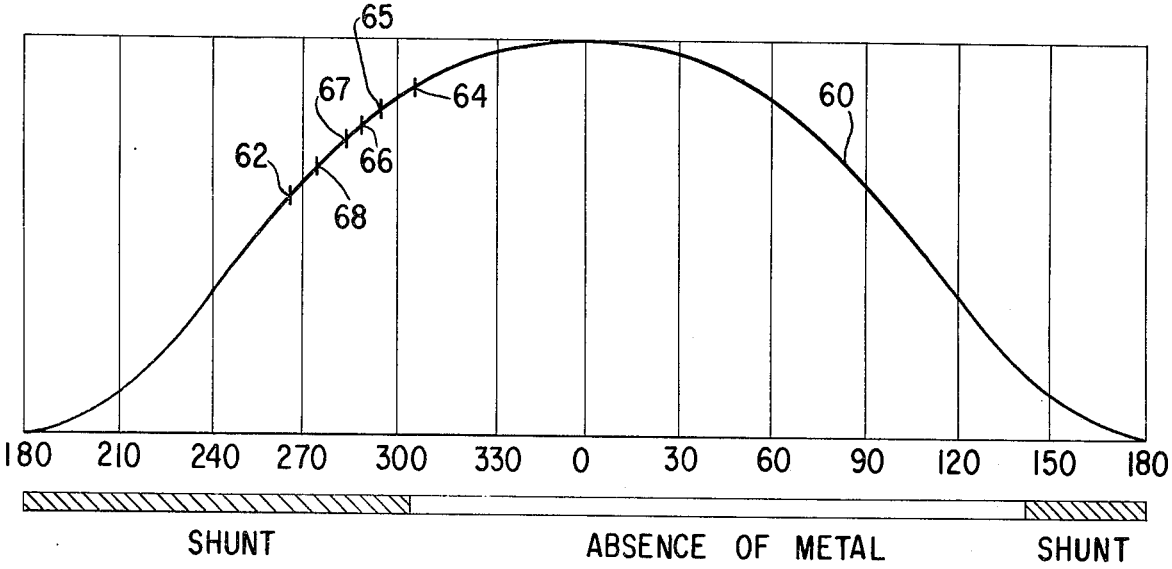
FIG. 2 is a timing diagram useful in understanding the present invention.

Referring now to FIG. 2, shown therein is a timing chart useful for illustrating the present invention. In FIG. 2, the curve 60 represents the vertical travel of the needle bar 18 during a complete cycle of the operation of the sewing machine, which cycle is considered to constitute 360° of motion, with the top dead center position of the needle bar 18 being the 0° reference. Basic system timing is achieved from the timing pulse generator 50. As described in the aforereferenced U.S. Pat. No. 3,939,372, the timing pulse generator 50 is illustratively a contact-free electrical pulse generaor that utilizes a Hall effect device and a permanent magnet (neither being shown) to generate lines of flux and provides two stable output states when cooperating with a flux conducting cam 52 having a stepped peripheral circumference mounted on the armshaft 14. As shown at the bottom of FIG. 2, the outer peripheral circumference, or shunt, of the cam 52 is proximate the Hall device from about 144° to about 302° of the operating cycle of the sewing machine, and there is an absence of metal proximate the Hall device during the remainder of the operating cycle of the sewing machine. Accordingly, when the armshaft 14 is rotating, the timing pulse generator 50 provides a series of pulses being at a first level for approximately 158° of the operating cycle of the sewing machine and at a second level for the remainder (202°) of the operating cycle of the sewing machine. In the prior art electronically controlled sewing machines, the transition from the absence of metal to the shunt, which occurs at approximately 144°, is utilized as the feed synchronization signal for initiating the processing of retrieved stitch pattern information to control the linear actuator 43. The transition from the shunt to the absence of metal, which occurs at approximately 302°, is conventionally utilized as the bight synchronization signal to initiate processing of the retrieved stitch pattern information to control the linear actuator 27, the needle 17 being above the work fabric at that time, having exited the throat plate at approximately 264°, as denoted by the point 62 on the curve 60, the conventional bight synchronization time being denoted by the point 64 on the curve 60.

FIG. 3 illustrates various time intervals at different operating speeds of the sewing machine. The first column of the table of FIG. 3 shows speeds between 850 RPM and 1200 RPM, the top speed of the sewing machine, in increments of 50 RPM. In the second column, the total operating cycle time, rounded off to the closest millisecond, is shown for the speed set forth in the first column. The third column shows the time, rounded off to the closest millisecond, during which the shunt portion of the cam 52 is proximate the Hall sensor. This shunt time is the time between the feed synchronization signal and the bight synchronization signal. The last column of FIG. 3 will be discussed in detail hereinafter.

FIG. 4 shows a general block diagram of a microcomputer based controller for an electronic stitch pattern sewing machine illustratively of the type disclosed in U.S. Pat. No. 4,159,688, which issued on July 3, 1979, to Garron et al, the disclosure of which is hereby incorporated by reference. Accordingly, the microcomputer 70 receives input signals from the pattern selector 72 indicative of which pattern the sewing machine operator desires to be sewn. The microcomputer 70 includes an internal central processor unit (CPU) 74 and a pattern ROM 76. The CPU 74 obtains from the pattern ROM 76, in timed relation with the operation of the sewing machine, according to timing signals received from the timing pulse generator 50, data for controlling the bight actuator system 78 and the feed actuator system 80. The bight actuator system 78 includes the linear actuator 27 and the feed actuator system 80 includes the linear actuator 43. The bight actuator system 78 and the feed actuator system 80 are similar in construction and are adapted to convert a digital code word from the microcomputer 70 into a mechanical position which locates the sewing machine needle in a conventional stitch forming instrumentality and provides a specific work feed for each needle penetration, respectively. Illustratively, the microcomputer 70 is a type R6500 microcomputer manufactured by Rockwell International Corporation wherein the central processor unit 74 provides addresses to the pattern ROM 76 over the leads 82 and receives in return bytes of data over the leads 84.

FIG. 5 is a block diagram illustrating a hardware implementation of the present invention which is useful in understanding the operation thereof. As shown in FIG. 5, feed synchronization pulses, as generated by the timing pulse generator 50, are provided on the lead 102 and a free running one kilohertz clock provides pulses on the lead 104. The feed synchronization pulses on the lead 102 are applied through a delay element 106 to the reset input 108 of a counter 110. The delay 106 is chosen to be less than 1 millisecond, which is the spacing between the clock pulses on the lead 104, but is of sufficient time duration to enable the remainder of the circuitry, to be described hereinafter, to operate on the contents of the counter 110 before the counter 110 is reset. The clock pulses on the lead 104 are applied to the counter 110 so that the counter 110 is incremented by one each time there is a clock pulse on the lead 104. Accordingly, the contents of the counter 110 provide an indication of the time, in milliseconds, since the immediately preceding feed synchronization pulse on the lead 102. The contents of the counter 110 are provided to the comparator 112 which, in response to a feed synchronization pulse on the lead 102, also applied to the comparator 112, determines whether the time between successive feed synchronization pulses is less than 71 milliseconds. Referring for a moment to the table of FIG. 3, it will be seen that if the time between successive feed synchronization pulses is less than 71 milliseconds, then the operating speed of the sewing machine is greater than or equal to 850 RPM. Accordingly, when the speed of the sewing machine is greater than or equal to 850 RPM, the comparator 112 will provide an output over the lead 114 which enables the circuit 116 to perform an arithmetic operation on the count provided by the counter 110. The circuit 116 divides this count by 2 and then substracts 8 therefrom and applies this number to a latch 118 for temporary storage therein. After these operations have been performed and a number has been stored in the latch 118, the delay 106 causes the counter 110 to be reset and resume counting. The comparator 120 compares the count provided by the counter 110 with the contents of the latch 118 and when they are equal provides a pulse on the lead 122. Accordingly, the pulse provided on the lead 122 occurs after a feed synchronization pulse after a delay period which has been calculated by the circuit 116. This delay period is an inverse function of the sewing machine speed and is set forth in the last column of the table shown in FIG. 3. The generated pulse on the lead 122 is substituted for the bight synchronization signal provided by the timing pulse generator 50 to advance the operation of the bight actuator system 78 at the higher sewing speeds to insure that the needle 17 is properly positioned in good time. Referring to FIG. 2, it will be recalled that the point 64 on the curve 60 is the point during the operating cycle where the bight synchronization signal generated by the timing pulse generator 50 occurs. According to the present invention, this will be the point where the bight synchronization signal will occur for sewing speeds below 850 RPM. According to the present invention, bight synchronization occurs at the point 65 for a sewing speed of 900 RPM; at the point 66 for a sewing speed of 1000 RPM; at the point 67 for a sewing speed of 1100 RPM; and at the point 68 for a sewing speed of 1200 RPM. The point 65 corresponds to 296°; the point 66 corresponds to 290°; the point 67 corresponds to 282°; and the point 68 corresponds to 273°.

Figure 6A:
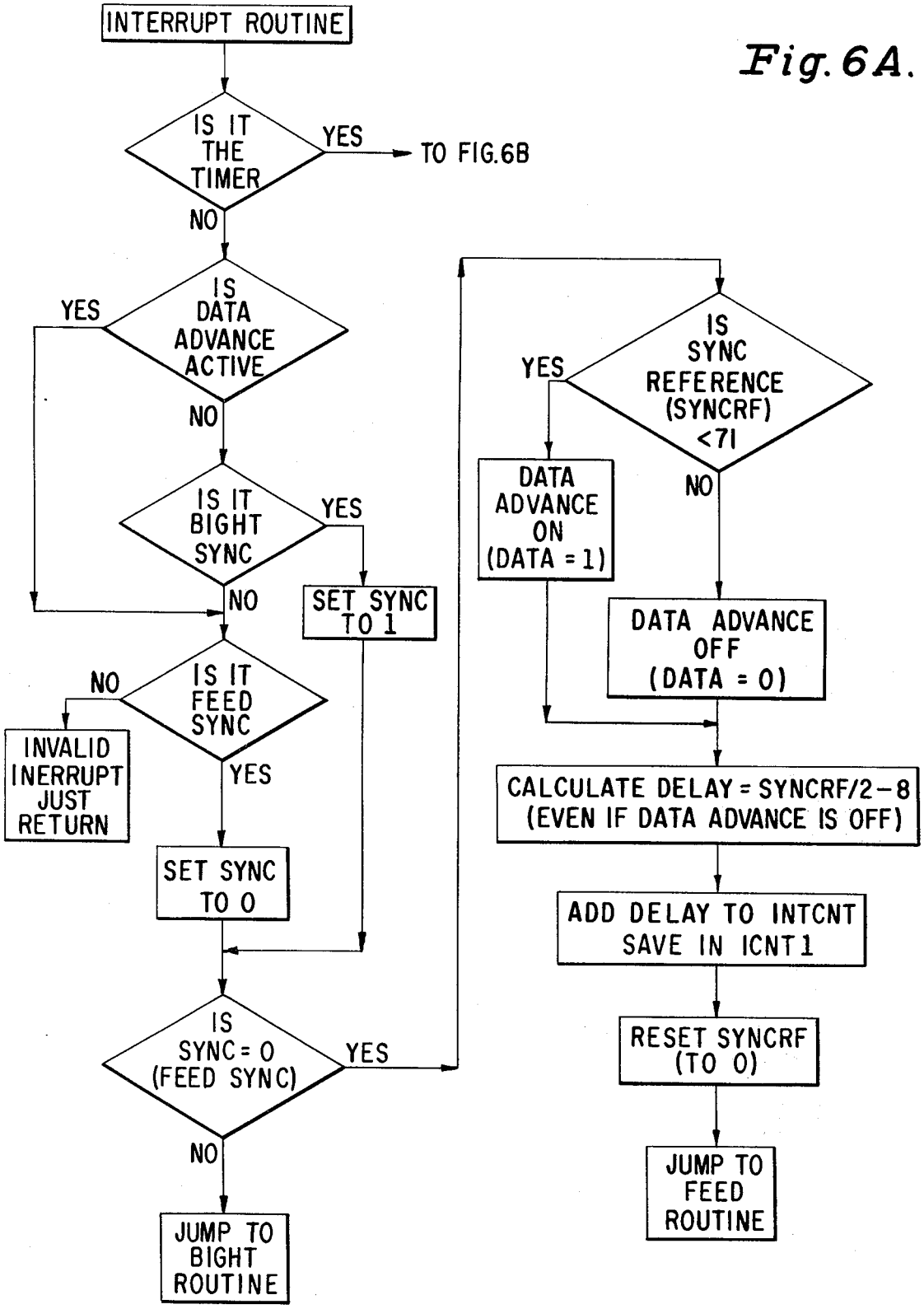
FIGS. 6A and 6B together form a flow diagram of the operation of the microcomputer shown in FIG. 3 when properly programmed in accordance with this invention.
Figure 6B:
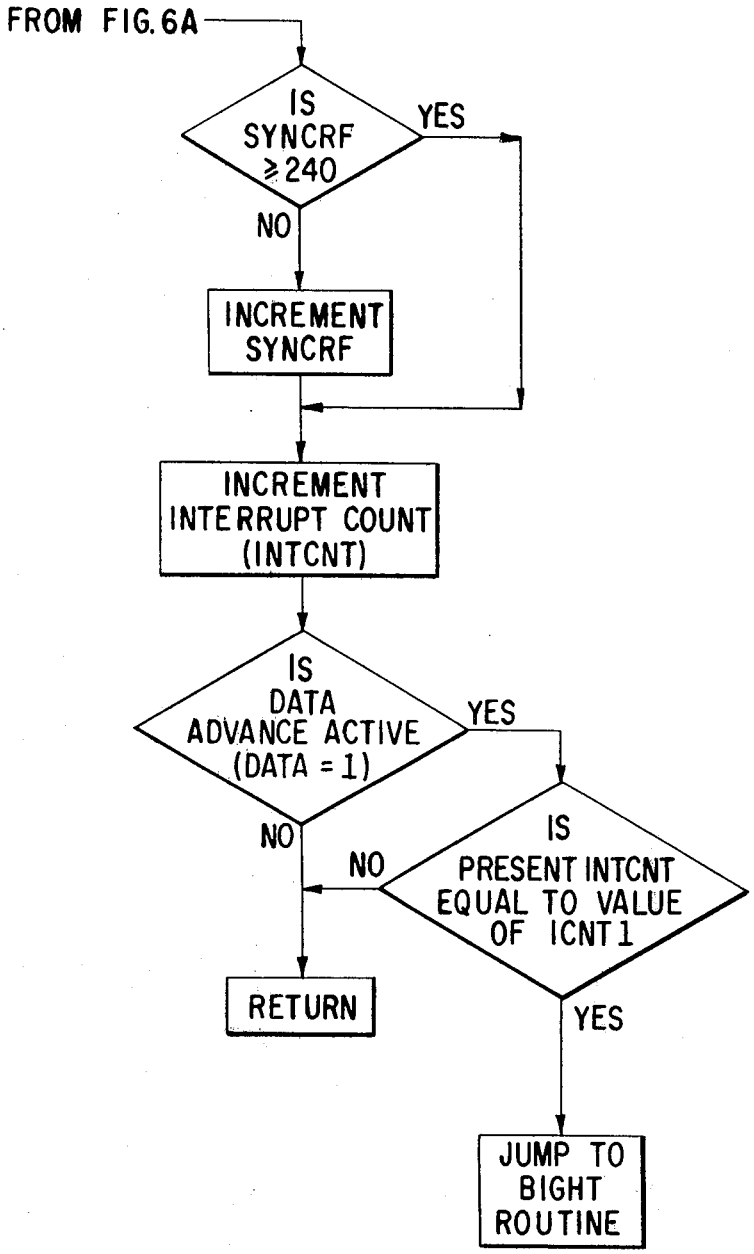

FIGS. 6A and 6B together depict a flow chart of the interrupt routine for the microcomputer 70, according to which the present invention may be implemented. The microcomputer 70 is interrupted by a pulse from the timing pulse generator 50 and also by a pulse from a free running one kilohertz clock timer. As shown in FIGS. 6A and 6B, when the microcomputer 70 detects an interrupt, it first checks to see whether the interrupt is caused by the one millisecond timer. If not, it was caused by either a feed synchronization pulse or a bight synchronization pulse from the timing pulse generator 50. The microcomputer 70 then checks to see whether the data advance is indicated as being active. This is accomplished by examining the DATA register which has been set to one if the data advance is to be active and to zero if the data advance is not to be active. The data advance is to be active if the sewing machine speed is detected as being greater than or equal to 850 RPM. If the data advance is not active, the microcomputer checks to see whether it was a feed synchronization signal or a bight synchronization signal. If neither, it is determined that the interrupt was an invalid interrupt and the microcomputer 70 returns to its previous task. If it was a bight synchronization signal, the microcomputer 70 sets the SYNC register to one. If a feed synchronization signal was received, whether or not the data advance was active, the SYNC register is set to zero. In the event that the data advance was not active and a bight synchronization pulse was detected, the microcomputer 70 jumps to the bight routine for controlling the bight actuator system 78.

The microcomputer 70 includes a synchronization reference counter SYNCRF which is examined each time a feed synchronization pulse is recognized. This counter corresponds to counter 110 (FIG. 5) and if the contents thereof are less than 71, the DATA register is set to one to indicate that data advance is active. This is the situation where the sewing machine speed is 850 RPM or greater. If SYNCRF is greater than or equal to 71, this indicates that the sewing machine speed is slower than 850 RPM and accordingly DATA is set to zero, indicating that the data advance is off. The next step is to calculate the delay interval by dividing the contents of SYNCRF by two and then substracting eight therefrom. The microcomputer 70 also includes an interrupt counter INTCNT which is incremented every millisecond. The calculated delay is added to the contents of INTCNT and stored for later use in register INCTl, which corresponds to the latch 118 (FIG. 5). SYNCRF is then reset to zero and the microcomputer 70 jumps to the feed routine in order to control the feed actuator system 80.

Referring to FIG. 6B, in the event that the interrupt was initiated due to a timer pulse, SYNCRF is checked to see whether it is greater than or equal to 240. If not it is incremented, as is the INTCNT register. If SYNCRF was greater than or equal to 240, it is not incremented. However, INTCNT is still incremented. The reason for this is to avoid an overlap of SYNCRF going to zero and starting over again in the event that the sewing machine is running at an extremely low speed. After INTCNT is incremented, the DATA register is examined to see whether the data advance is active. If not, the microcomputer 70 returns to its normal operation. If the data advance is active, the present value of INTCNT is compared to the value of ICNTl. If these values are not equal, the microcomputer returns to its normal operation. If the values are equal, this means that the present time is the calculated delay interval after the last feed synchronization pulse and hence, the microcomputer 70 jumps to the bight routine to control the bight actuator system 78 just as if it had received a bight synchronization pulse from the timing pulse generator 50. In effect, a calculated bight synchronization pulse is substituted for a mechanically generated bight synchronization pulse.

The APPENDIX to this specification is an illustrative program listing which may be utilized in the microcomputer 70 to control the microcomputer 70 in accordance with the flow charts illustrated in FIGS. 6A and 6B, and discussed above.

Accordingly, there have been disclosed arrangements for advancing the operation of a mechanically synchronized sewing machine. It is understood that the above-described embodiments are merely illustrative of the application of the principles of this invention. Numerous other embodiments may be devised by those skilled in the art without departing from the spirit and scope of this invention, as defined by the appended claims.

APPENDIX

| LABEL | INSTR. | MODIFIER | COMMENTS |
|---|---|---|---|
| | INTERRUPT ROUTINE | | |
| IRQINT | LDX | #$01 | |
| | LDY | #$00 | SET UP X AND Y REGISTERS |
| | LDA | CONREG | |
| | BMI | COUNT | BIT 7 IS COUNTER DETECT |
| | LDA | DATA | |

-continued

APPENDIX

| LABEL | INSTR. | MODIFIER | COMMENTS |
|---|---|---|---|
| | BNE | NOTBTE | IF DATA IS ON THEN SKIP BIGHT |
| | LDA | CONREG | |
| | AND | #$20 | CHECK FOR BIGHT EDGE FIRST |
| | BEQ | NOTBTE | |
| | STX | SYNC | SYNC = 1 |
| | BEQ | MACSNC | JUMP TO MACHINE SYNC |
| NOTBTE | LDA | CONREG | |
| | AND | #$40 | CHECK FOR FEED SYNC |
| | BNE | CONT1 | |
| | RTI | | RETURN FROM INTERRUPT |
| CONT1 | STY | SYNC | SYNC = 0 |
| | MACHINE SYNC ROUTINE | | |
| MACSNC | LDA | SYNC | |
| | BEQ | CONT2 | |
| | JMP | BIGHT | IF 1 THEN JUST JUMP TO BIGHT |
| CONT2 | LDA | SYNCRF | |
| | CMP | #71 | 850 RPM |
| | BCS | NDATA | >70 MS SO <850 RPM |
| | STX | DATA | DATA = 1 >/ = 850 RPM |
| | BCC | CONT3 | JUMP |
| NDATA | STY | DATA | <850 RPM DATA = 0 |
| CONT3 | LDA | SYNCRF | |
| | LSR A | | DIV BY 2 |
| | SEC | | |
| | SBC | #08 | A-08-C' = >A-08 |
| | ADC | INTCNT | (RESULTS) + INTCNT + C (C = 0 FROM SEC) |
| | STA | ICNT1 | |
| | STY | SYNCRF | RESET SYNCRF |
| | JMP | FEED | EXECUTE FEED SYNC ROUTINE |
| | INTERVAL TIMER INTERRUPT ROUTINE | | |
| COUNT | LDA | SYNCRF | |
| | CMP | #$FO | |
| | BCS | NOINC | IF SYNCRF = FO (HEX) THEN DON'T INC SYNCRF. THIS AVOIDS OVERLAPPING |
| | INC | SYNCRF | |
| NOINC | INC | INTCNT | |
| | LDA | DATA | |
| | BEQ | OUTA | IF DATA = 0 JUST RTI NORMALLY |
| | LDA | INTCNT | |
| | CMP | ICNT1 | IF DATA = 1 AND INTCNT = ICNT1 THEN JUMP TO BIGHT AND RTI FROM THERE |
| | BNE | OUTA | |
| | JMP | BIGHT | EXECUTE BIGHT SYNC ROUTINE |
| OUTA | RTI | | RETURN FROM INTERRUPT |

We claim:

1. In an electronically controlled stitch pattern sewing machine including at least one stitch forming instrumentality positionally controllable over a predetermined range, memory means for storing pattern stitch information, means for providing a first synchronization signal at a first fixed point during each operating cycle of the sewing machines, means for providing a second synchronization signal at a second fixed point during each operating cycle of the sewing machine, retrieval means utilizing said first and second synchronization signals for operating in timed relation with said sewing machine to retrieve selected pattern stitch information from said memory means, and actuating means responsive to the retrieved pattern stitch information for controlling the position of said stitch forming instrumentality, the improvement comprising:

means for sensing when the speed of operation of the sewing machine is faster than a predetermined speed;

signal generating means responsive to the sensed speed being faster than said predetermined speed for generating a third synchronization signal which occurs after said first synchronization signal and before said second synchronization signal; and means for substituting said third synchronization signal in place of said second synchronization signal for response thereto by said retrieval means.

2. The improvement according to claim 1 wherein said sensing means includes means for timing the interval between successive occurrences of said first synchronization signal.

3. The improvement according to claim 2 wherein said timing means includes:

a source of fixed frequency clock pulses;

resettable counting means for counting said clock pulses; and means for applying said first synchronization signal to said counting means so as to reset said counting means upon each occurrence of said first synchronization signal.

4. The improvement according to claim 3 wherein said sensing means further includes means responsive to each occurrence of said first synchronization signal for examining the count provided by said counting means and determining if said count is below a threshold count corresponding to said predetermined speed.

5. The improvement according to claim 1 wherein said signal generating means includes means for varying the time interval between said first synchronization signal and said third synchronization signal as an inverse function of the sewing machine speed.

6. The improvement according to claim 5 wherein said sensing means includes a source of fixed frequency clock pulses, resettable counting means for counting said clock pulses, and means for applying said first synchronization signal to said counting means so as to reset said counting means upon each occurrence of said first synchronization signal, and said signal generating means includes means for calculating a speed dependent count number and means responsive to the count of said counting means equalling said speed dependent count number for generating said third synchronization signal.

7. The improvement according to claim 6 wherein said calculating means is operative to divide by two and then subtract eight from the maximum count reached by said counting means before said counting means is reset.

* * * * *